US005276447A

United States Patent [19]

Shingo

[11] Patent Number: 5,276,447

[45] Date of Patent: Jan. 4, 1994

[54] RADAR ECHO REDUCTION DEVICE

[75] Inventor: Mika Shingo, Nagoya, Japan

[73] Assignee: Mitsubishi Jukogyo Kabushiki Kaisha, Tokyo, Japan

[21] Appl. No.: 868,738

[22] Filed: Apr. 15, 1992

[30] Foreign Application Priority Data

Apr. 16, 1991 [JP] Japan ..... 3-84033

[51] Int. Cl.[5] ..... H01Q 17/00

[52] U.S. Cl. ..... 342/2; 342/13; 342/4

[58] Field of Search ..... 342/1, 2, 3, 4, 13, 342/14

[56] References Cited

U.S. PATENT DOCUMENTS

| | | | |
|---|---|---|---|
| 2,436,578 | 2/1948 | Korn et al. | 342/2 X |
| 2,992,425 | 7/1961 | Pratt | 342/1 |
| 3,290,680 | 12/1966 | Wesch | 342/1 |
| 3,508,265 | 4/1970 | Ellis | 342/1 |
| 3,540,047 | 11/1970 | Walser et al. | 342/1 |
| 3,599,210 | 8/1971 | Stander | 342/2 |
| 3,698,338 | 10/1972 | Hymowitz | 342/1 X |
| 3,713,157 | 1/1973 | August | 342/2 |
| 3,733,606 | 5/1973 | Johansson | 342/3 |
| 3,838,425 | 9/1974 | Ishimitsu et al. | 342/2 |
| 3,887,920 | 6/1975 | Wright et al. | 342/1 |
| 3,997,899 | 12/1976 | Rolsma | 342/2 |
| 4,006,479 | 2/1977 | LaCombe | 342/1 |
| 4,019,699 | 4/1977 | Wintersdorff et al. | 342/2 X |
| 4,118,704 | 10/1978 | Ishino et al. | 342/4 |
| 4,716,417 | 12/1987 | Grumet | 343/708 |
| 4,924,228 | 5/1990 | Novak et al. | 342/2 |
| 4,960,633 | 10/1990 | Hiza et al. | 428/215 |
| 5,014,060 | 5/1991 | Novak et al. | 342/2 |
| 5,016,015 | 5/1991 | Novak et al. | 342/2 |
| 5,047,296 | 9/1991 | Miltenberger et al. | 342/1 X |
| 5,057,842 | 10/1991 | Möller et al. | 342/4 |
| 5,063,384 | 11/1991 | Novak et al. | 342/1 |
| 5,084,705 | 1/1992 | Frye et al. | 342/1 |

OTHER PUBLICATIONS

Raymer, Daniel P., *Aircraft Design: A Conceptual Approach,* American Institute of Aeronautics and Astronautics, Inc., (Washington, D.C. 1989), pp. 164–169.

Richardson, Doug, *Stealth Warplanes,* Salamander Books Limited (London 1989), pp. 25–49.

Miller, Jay, *Northern B-2 Stealth Bomber,* Specialty Press (Minn. 1991) pp. 1–7.

Fuhs, Allen, E., *Radar Cross Section Lectures,* American Institute of Aeronautics and Astronautics (New York 1989) pp. 91–97.

Jones, Joseph, *Stealth Technology The Art of Black Magic,* Tab Books Inc. (Pa. 1989) pp. 43–51.

Goodall, Jim, *F-117 Stealth in Action,* Squadron/Signal Publications Inc. (Texas 1991) pp. 7–9.

*Primary Examiner*—John B. Sotomayor

*Attorney, Agent, or Firm*—Wenderoth, Lind & Ponack

[57] ABSTRACT

Radar echo reduction in an aircraft and the like provides a radar reflective rear edge that is independent of the configuration of a main wing or the like. In a particular object required to suppress radar echoes such as, for example, an aircraft, a ship such as a warship, a special vehicle, a bridge or the like, the radar echo reduction constituent is a conductive thin layer equipped on an outer surface of the object and having its terminal rear edge oriented obliquely to the expected direction of an incoming radar wave.

15 Claims, 10 Drawing Sheets

RADAR ECHO REDUCTION DEVICE

BACKGROUND OF THE INVENTION

1. Field of the Invention

The present invention relates to a radar echo reduction in an aircraft or the like.

2. Description of the Prior Art

A plan view of a prior art aircraft having radar echo reduction is shown in FIG. 11. In order that a reflection electromagnetic wave 04, generated when induction currents 03 induced on a main wing surface by a radar wave 02 irradiated from the front of an aircraft 01 have reached a main wing rear edge 05, is prevented from returning in a direction toward the radar, the main wing rear edge 05 is provided with a large sweep-back angle.

The above-mentioned aircraft in the prior art presents the following problems to be resolved.

That is, a main configuration having a large sweep-back angle gives rise to the problem that when stalling has occurred at a wing end portion, a strong nose-up moment is generated which is undesirable in view of stability and maneuverability of the aircraft, and to the problem that a sufficient strength and rigidity against bending and twisting cannot be assured in view of structural mechanics.

SUMMARY OF THE INVENTION

It is therefore one object of the present invention to provide radar echo reduction for an aircraft or the like which forms a radar reflective edge independently of a configuration of a main wing or the like.

According to one feature of the present invention, as a measure for resolving the above-mentioned problems in the prior art, there is provided a radar echo reduction constituent of an object such as an aircraft, a ship, a special vehicle, a civil engineering structure or a building or the like, which comprises a conductive thin layer equipped on an outer surface of a structural component of the object and having its terminal rear edge with respect to an expected direction of an incoming radar wave formed obliquely with respect to the direction of the radar wave.

It is to be noted here that the term "equipped on an outer surface" refers to every measure of forming a conductive thin layer on an outer surface such as by painting, adhesion, vapor deposition, as well as by bonding a thin sheet of electrically conductive material to the surface. In addition, the term "conductive thin layer" includes, for instance, the following substances and materials.

(1) Malleable and conductive metal foils such as gold, silver and copper foils. It is to be noted that in this case the foil will be typically adhered to the object such as an airframe and the like.

(2) Metal films which are formed by surface treatment such as plating, vapor deposition, crystal growth or baking by laser beams, such as lead and tin films.

(3) Coatings of conductive paint.

(4) In the case where an outer plate of an airframe or the like is made of polymer, a conductive polymer formed by doping the surface of the outer plate with a conductive material such as iodine or the like.

(5) Fiber-reinforced composite material in which the outermost layer is made of conductive fibers, and the fibers are aligned in parallel to one another. In the case of an aircraft, the composite material will be applied with the fibers parallel to the airframe axis.

However, among the above-described conductive materials, the metal foil (1) which is easy to work and which can form a uniform film, and moreover which is strong enough to prevent it from forming cracks liable to generate a reflection wave, is most easy to control a reflection wave at present, and so it is preferable.

Owing to the above-mentioned structural features, the present invention provides the following operational advantages.

That is, since the particular object is provided with a conductive thin layer equipped on an outer surface of the object and having its rear edge formed obliquely with respect to an expected direction of the incoming radar wave, a radar wave propagating in the incoming direction generates, within the conductive thin layer made of a good conductor, an induction current flowing from its rear edge. Because conductivity decreases, i.e. there is a discontinuity, at the boundary defined by the rear edge of the conductive thin layer, a part of the induction current is radiated as a reflected electromagnetic wave. As a result, the wave reflects obliquely from the rear edge of the conductive thin layer in a direction independent of the rear edge of the particular object.

BRIEF DESCRIPTION OF THE DRAWINGS

The above-mentioned and other objects, features and advantages of the present invention will become more apparent by reference to the following description of a number of preferred embodiments of the invention taken in conjunction with the accompanying drawings.

In the accompanying drawings.

DETAILED DESCRIPTION OF THE PREFERRED EMBODIMENTS

Now, preferred embodiments of the present invention will be explained with reference to FIGS. 1 to 10. It is to be noted that FIGS. 1 to 4, 9 and 10 show only one side of an aircraft with respect to its airframe axis, in plan. In every figure, a conductive foil is represented by hatching. Also in every figure, unless otherwise noted, the illustrated aircraft, special vehicle or warship will travel toward the left as viewed in the figure.

Figure 1:
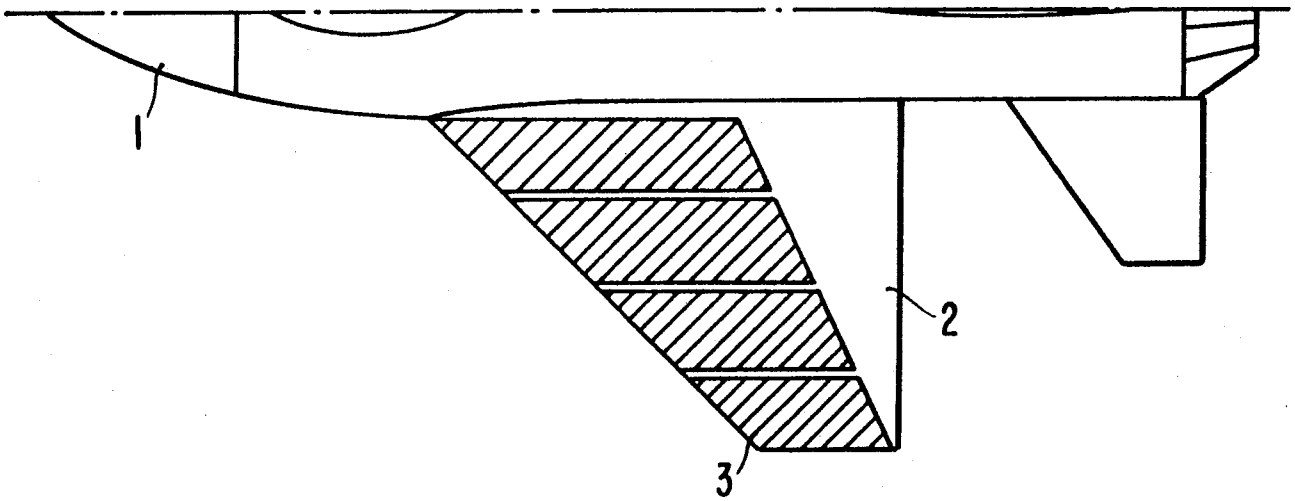
FIG. 1 is a plan view of one side of one embodiment of an aircraft according to the present invention.
Figure 2:
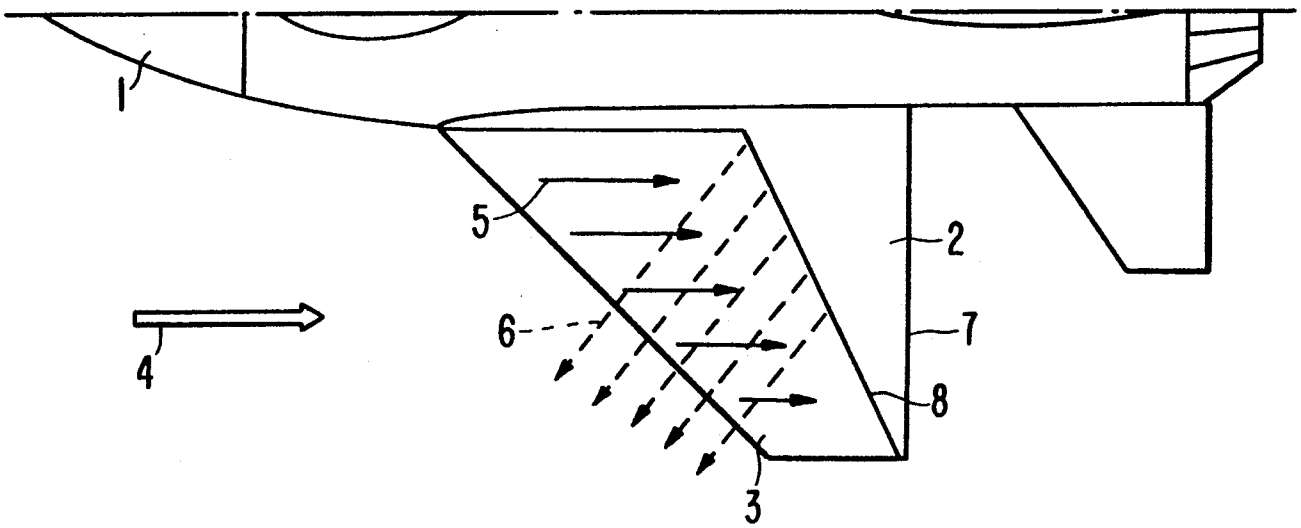
FIG. 2 is a schematic view illustrating effects produced by the first preferred embodiment.

At first, the first preferred embodiment will be described with reference to FIGS. 1 and 2. In FIG. 1, conductive foils 3 are adhered to the surface of a main wing 2 of an aircraft 1. As shown in the figure, the rear edges of the conductive foils 3 are in alignment at a sweep-back angle that is different from a sweep-back angle of rear edge of the main wing 2. When the aircraft 1 has been irradiated with a radar wave from its front, induction currents 5 (FIG. 2) generated on the upper surface of the main wing 2 reach the rear edges 8 of the conductive foil 3 before they reach the main wing rear edge 7. Due to a discontinuity at edge 8 where there is experienced a reduction in conductivity, reflected electromagnetic waves 6 are formed in the direction of the dashed-like arrows. This direction of the reflected electromagnetic waves 6 is identical to that in which the waves would travel if the main wing of the aircraft consisted of that portion of the wing 2 covered by the conductive foils 3. Accordingly, a direction of reflection of radar waves 4 can be varied without changing the sweep-back angle of the main wing 2.

Figure 3:
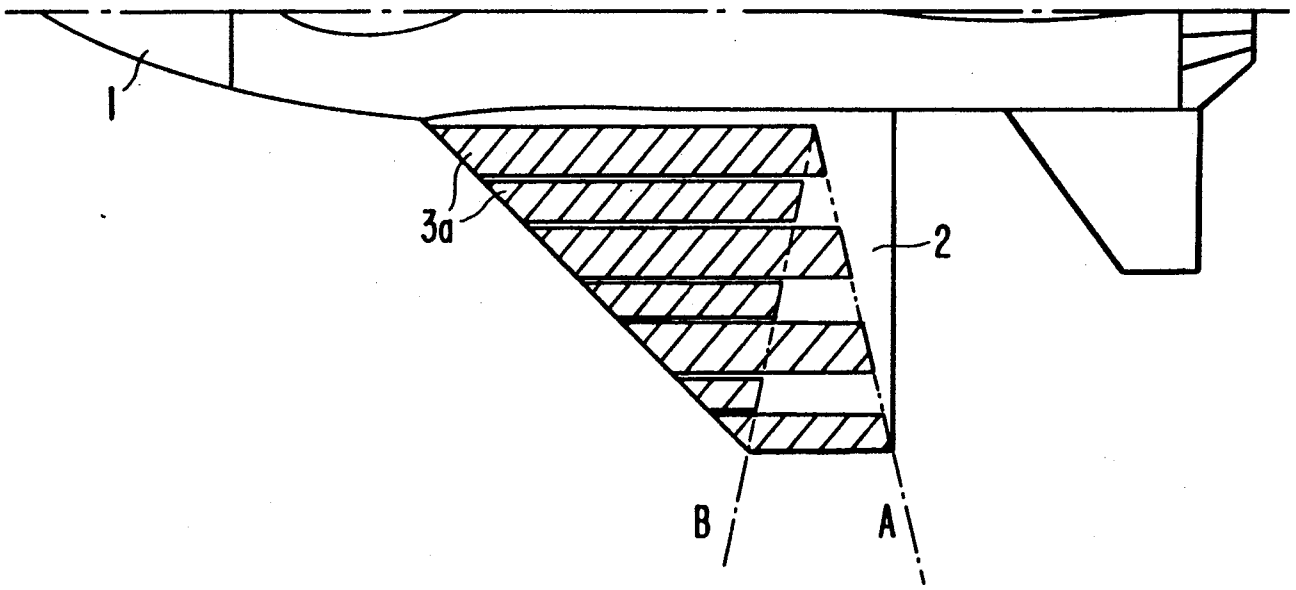
FIG. 3 is a plan view of one side of a second embodiment of an aircraft according to the present invention.

Next, a second preferred embodiment will be described with reference to FIG. 3. In FIG. 3, strip-like conductive foils 3*a* are adhered to a surface of a main wing 2 of an aircraft 1, and the rear ends of alternately disposed ones of these strip-like conductive foils 3*a* are aligned along different straight lines A and B, respectively. In the event that the wing 2 is irradiated with a radar wave, since waves are reflected from both the straight lines A and B, respectively, having different inclination angles with respect to the airframe shaft, the reflected waves are dispersed. Thus, a strong reflection wave is prevented from being generated in a particular direction.

Figure 4:
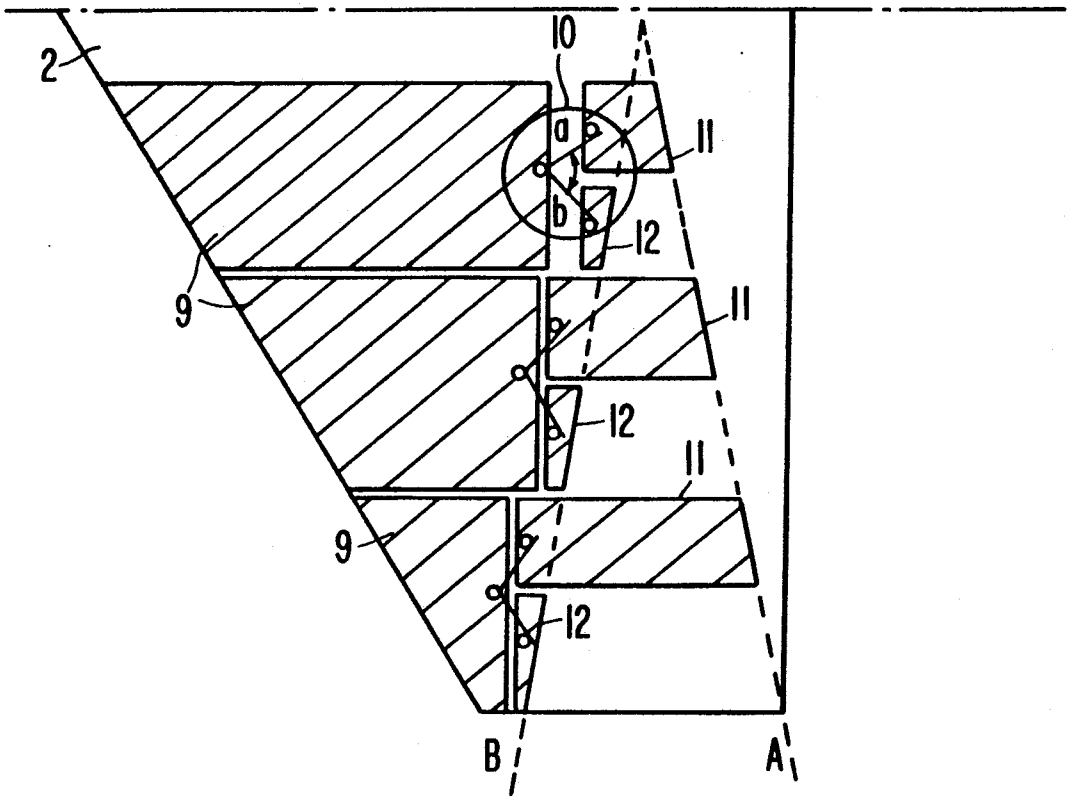
FIG. 4 is a plan view of a main wing on one side of a third embodiment of an aircraft according to the present invention.

Now, a third preferred embodiment will be described with reference to FIG. 4. In FIG. 4, conductive foils on the main wing surface 2 are severed into front and rear sections. The respective rear ends of the rear section conductive foils 11 and 12 are aligned along different straight lines A and B, respectively, similarly to the second preferred embodiment, and switches 10 are provided between front section conductive foils 9 and the rear section conductive foils 11 and 12. When the switches 10 are turned to position a in FIG. 4, the front section conductive foil 9 and the rear section conductive foil 11 are connected together. In this case, induction currents generated on the surface of the main wing 2 would generate a reflection wave from the straight line A. Likewise, when the switches 10 are turned to a position b, a reflection wave is generated from the straight line B.

As described above, by switching the switch 10 the direction of the reflection wave can be changed during flight.

Figure 10:
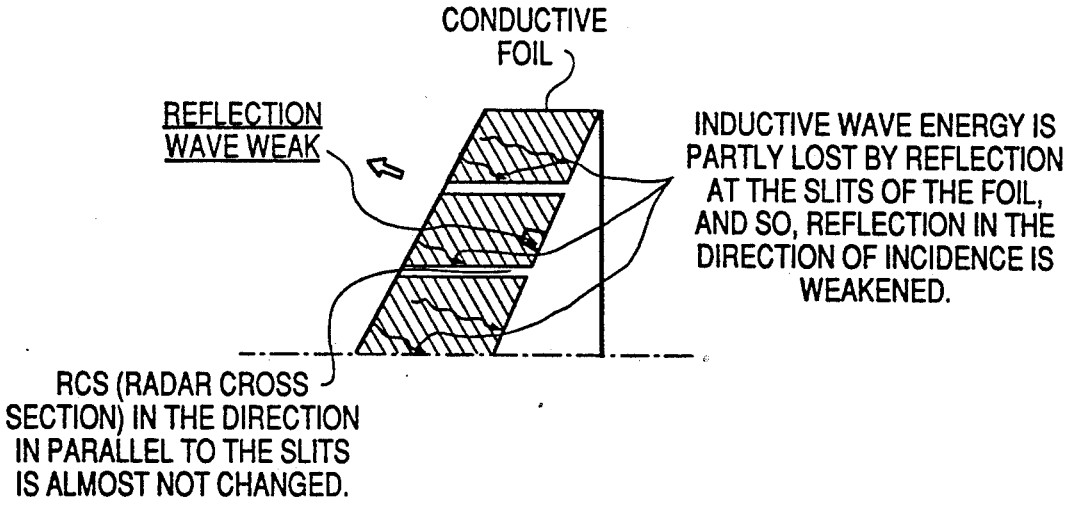
FIG. 10 is a plan view of a wing according to the present invention which is provided with a conductive foil having slits directed in the axial direction of an aircraft for purposes of explaining the effects produced by the first to third preferred embodiments of the present invention.
Figure 11:
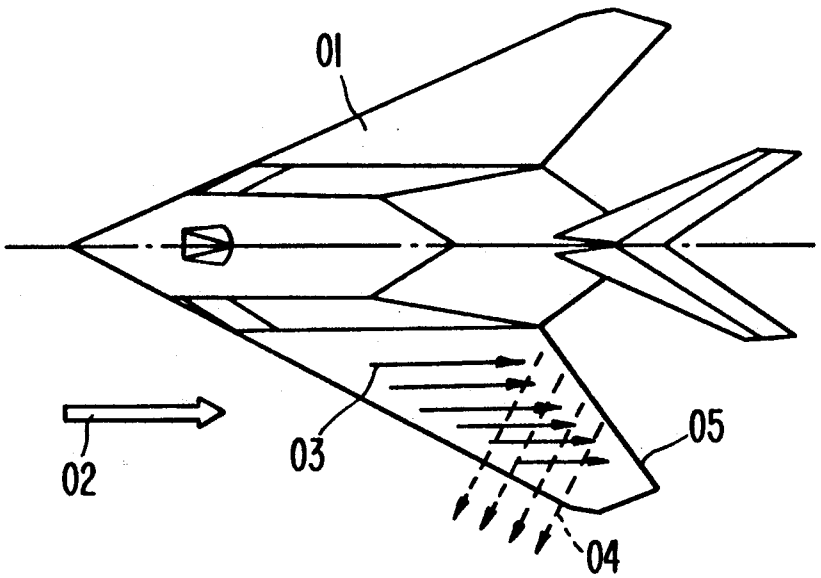
FIG. 11 (PRIOR ART)
FIG. 11 is a plan view of one example of a prior art aircraft.

In the above-described respective embodiments, the conductive foils 3 and 3*a*, the front section conductive foils 9, and the rear section conductive foils 11 and 12 (hereinafter, in some cases, simply "conductive foil"), are in the form of a plurality of strips severed from one another and extending parallel to the airframe axis. This is so that even in the case where an electromagnetic wave is incident from a direction perpendicular to the rear edge of the conductive foil, the strength of the reflected wave is weakened as much as possible. That is, if the foil was not in the form of a plurality of strips and, as shown schematically in FIG. 9, an electromagnetic wave were to propagate in a direction perpendicular to the rear edge of the conductive foil, then the energy of the inducted electromagnetic wave caused thereby would be reflected from along the entirety of the rear edge of the conductive foil. The intensity of the reflected wave would thus be extremely strong. On the other hand, by forming the conductive foil as a plurality of spaced apart strips as schematically shown in FIG. 10, and as is the case with the first to third preferred embodiments, even if an electromagnetic wave should propagate in a direction perpendicular to the rear edges of the strips of the conductive foil, the intensity of the wave reflected back in the direction of incidence would be small because a substantial amount of the induction current would impinge the lateral edges of the strips in a direction obliquely thereto and thus would produce reflection waves. Accordingly, there is a remarkable effect of not only suppressing the generation of reflected waves when an electromagnetic wave propagates along the wing from the front direction of the airframe, but also when the electromagnetic wave propagates in a direction perpendicular to the rear edge of the conductive foil.

Next, a fourth preferred embodiment of the present invention will be described with reference to FIG. 5. In this preferred embodiment, besides the main wings 2, conductive foils 15 are stuck via an adhesive to a fuselage 12, a horizontal tail 14 and a vertical tail 13. The rear edges of these conductive foils 15 extend obliquely with respect to the airframe axis.

Although an electromagnetic wave transmitted from a radar positioned far in the front direction of the aircraft 1 will induce currents in the respective conductive foils 15, these induction currents flowing from the front portion of the airframe towards the rear generate reflection electromagnetic waves at the rear edges of the conductive foils 15 most strongly in a direction (mirror image direction) as if the rear edges were a mirror. As a result, the reflected waves would propagate obliquely with respect to the airframe axis. A wave would not be reflected back to the radar in a direction parallel to the air-frame axis. The aircraft 1 would thus be hard to be detected by the radar.

Figure 5:
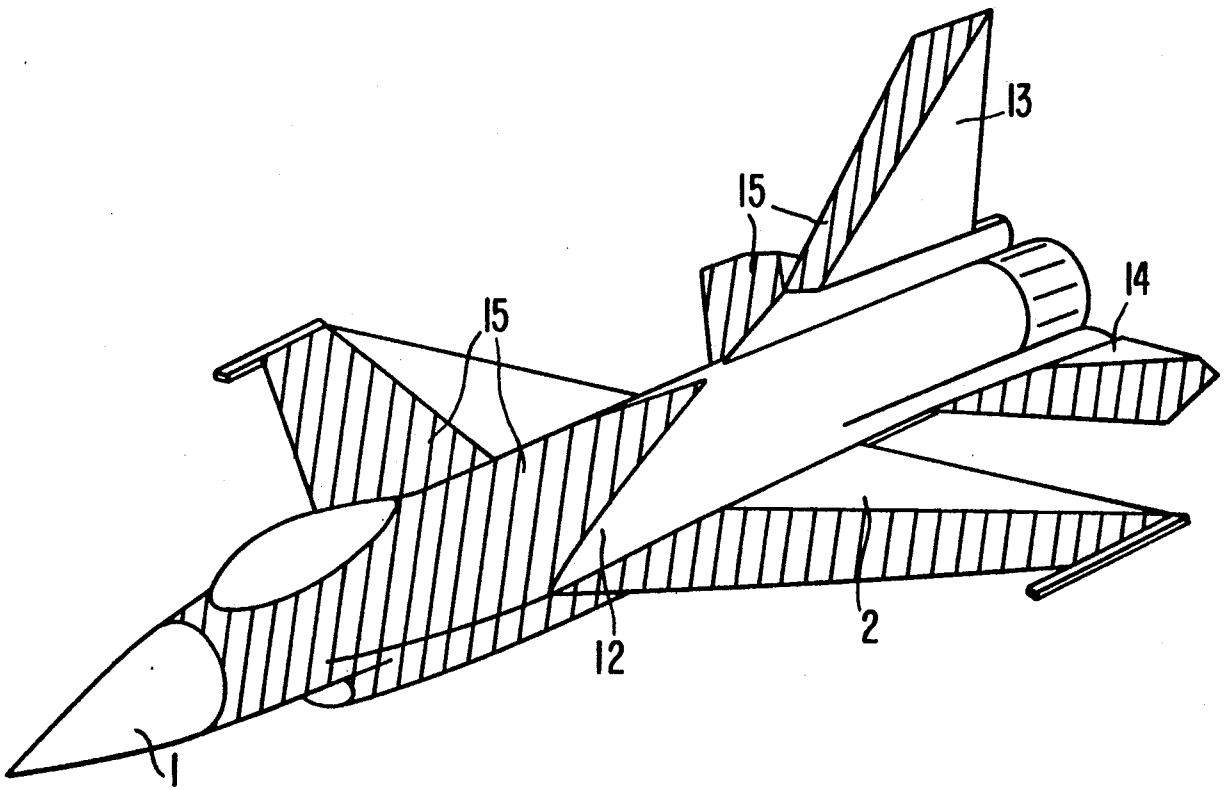
FIG. 5 is a perspective view of a fourth embodiment of an aircraft according to the present invention.

It is to be noted that although the conductive foils 15 are shown by hatching as being contiguous for convenience of illustration in FIG. 5, it is desirable to form each of the foils 15 as a plurality of strips.

Figure 6:
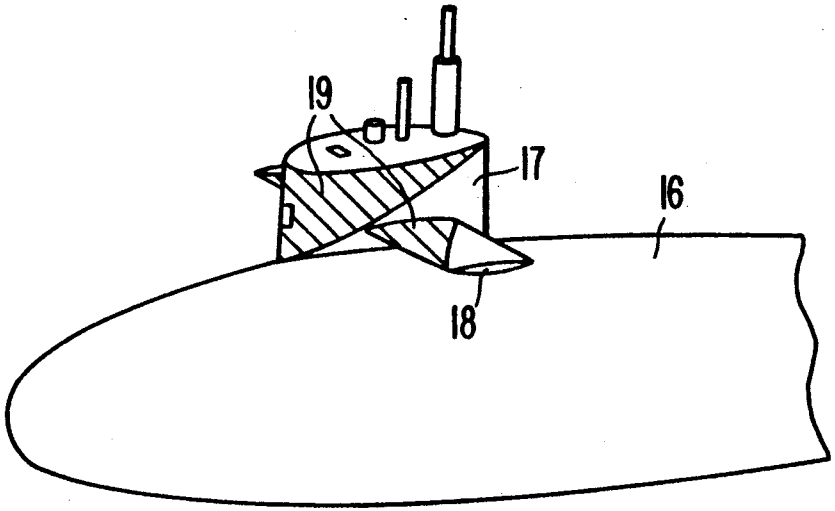
FIG. 6 is a perspective view of a submarine according to the present invention.

Next, an application of the present invention to a submarine will be explained with reference to FIG. 6. In FIG. 6, reference numeral 16 designates a submarine, numeral 17 designates a bridge, numeral 18 designates fins and numeral 19 designates conductive foils. Although objects in water are not normally detected by an electromagnetic wave this application is nonetheless useful for a submarine 16 when floating on the surface. When the submarine 16 floats on the surface of the sea substantially only the bridge 17 and the fins 18 are exposed. In this preferred embodiment, conductive foils 19 having their rear edges formed obliquely are adhered to the bridge 17 and the fins 18. As a result, an electromagnetic wave transmitted from an enemy's radar positioned in front of the submarine 16 would generate induction currents in the conductive foils 19 on the bridge 17 and the fins 18 of the floating submarine 16, and these induction currents are reflected as electromagnetic waves at the rear ends of the conductive foils 19. These reflection electromagnetic waves will not return in the direction of incidence because the rear edges of the conductive foils 19 extend obliquely to the longitudinal axis of the submarine 16. Accordingly, the reflection waves will not reach the enemy,s radar positioned in front of the submarine 16, and the submarine hardly be observable by the radar.

Figure 7:
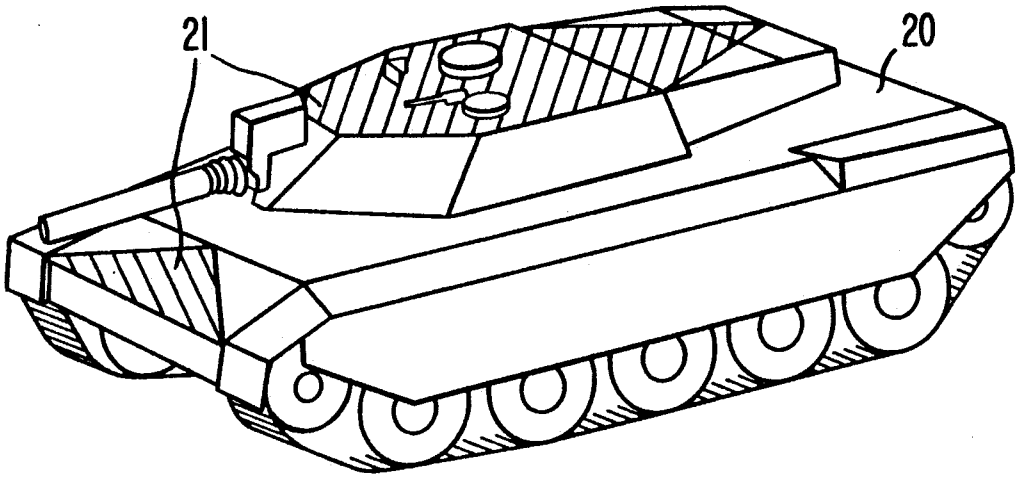
FIG. 7 is a perspective view of a tank according to the present invention.

Next, an application of the present invention to a special vehicle is shown in FIG. 7. In this figure, reference numeral 20 designates a tank, and numeral 21 designates conductive foils. In this preferred embodiment, conductive foils 21 are stuck via an adhesive onto a front surface panel and a top surface panel, respectively, of the tank 20. The respective conductive foils 21 all have their rear edge formed as two of the legs of a triangle. For reasons similar to those described in connection with the fifth preferred embodiment, the reflection waves will not return in the direction of incidence, so that the tank 20 is hardly observable by the enemy's radar.

Figure 8:
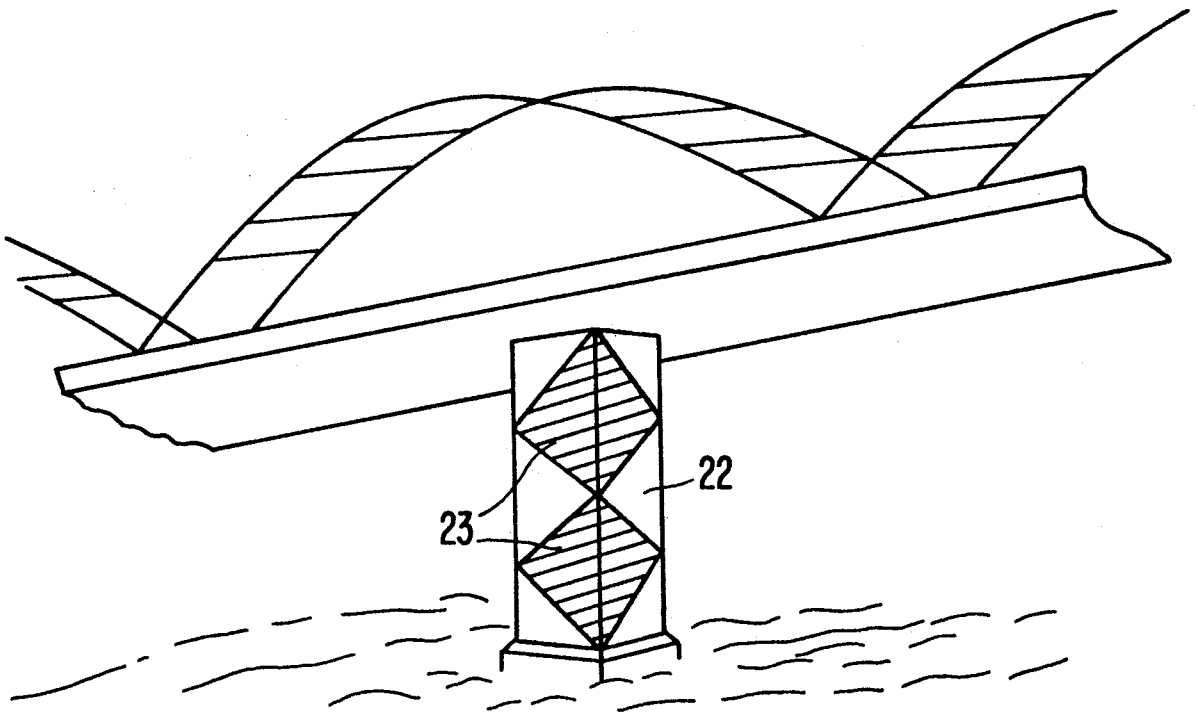
FIG. 8 is a perspective view of a bridge according to the present invention.
Figure 9:
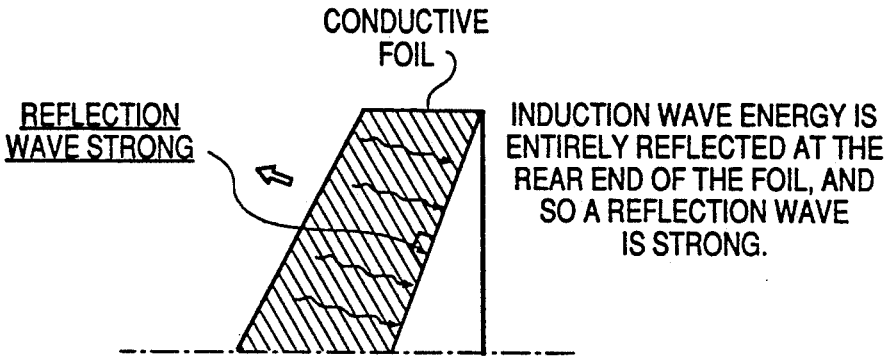
FIG. 9 is a plan view of a wing of an aircraft provided with a conductive foil which does not have a slit directed in the axial direction of the aircraft (an unfavorable example) for purposes of comparison with the first to third preferred embodiments of the present invention.

Now, an application of the present invention to the piers of a bridge will be explained with reference to FIG. 8. In this preferred embodiment, conductive foils 23 having the shape of a lozenge are adhered to a pier 22. Because the reflection waves propagate in different directions from the direction of incidence the bridge is hardly observable by the enemy's radar.

While a conductive foil was used to provide a thin conductive layer in the above-described respective preferred embodiments, the present invention is not so limited. For instance, a plated layer, a vapor-deposited layer, a layer formed by baking, painting or the like could be employed. Also, these layers could be directly applied to the surface of an aircraft or the like, after having been applied to a cloth, a thin film or another thin body. The thin body could be integrated with the surface of the aircraft or the like by an adhesive. As a matter of course, the layers of conductive material could be in the form of reinforcement fibers or in the form of impregnated material.

As will be obvious from the above description, owing to the fact that the rear edges of the conductive foils extend obliquely with respect to the direction of an incoming radar wave, radar reflection waves would propagate in directions different from the direction of incidence of the radar wave, regardless of the direction of the rear edge of the effected part of the aircraft 1, bridge 17 of the submarine, the panel of the special vehicle 20 or the pier 22 of the bridge. Therefore, the reflection intensity in the radar direction is greatly reduced.

That is, for instance, since a radar wave is reflected back in a direction that is independent of a sweep-back angle of a main wing rear edge of an aircraft, the aircraft can be made difficult to detect by radar without compromising the aerodynamic and structural-mechanic characteristics of main wings.

While a principle of the present invention has been described above in connection with a number of preferred embodiments, it is intended that all matter contained in the above description and illustrated in the accompanying drawings be interpreted as illustrative of the present invention and not in a limiting sense.

What is claimed is:

1. A craft which is difficult to detect by radar, said craft having a main body whose longitudinal axis extends in a direction corresponding to the forward direction of the craft, and a radar echo reduction constituent comprising a thin layer of electrically conductive material extending at only a portion of the outer surface of at least one structural component of the craft, said layer terminating at a rearmost edge thereof with respect to said forward direction of the craft, said rearmost edge being located forwardly of a rearmost end of said structural component such that a discontinuity in electrical conductivity occurs at the boundary between that portion of the structural component over which said layer extends, and that portion of the structural component which is not covered by said layer, and said rearmost edge of the layer being oblique to a plane perpendicular to said longitudinal axis of the main body of the craft, whereby when a radar wave irradiates the craft from the front thereof in the direction of the longitudinal axis of the main body of the craft, currents induced in the layer by said wave will be reflected at the rearmost edge of the layer, due to said discontinuity, as an electromagnetic wave propagating in a direction that is non-parallel to the direction in which the radar wave irradiated the craft.

2. A craft as claimed in claim 1 and which is an aircarft, wherein said main body is a fuselage, and said fuselage constitutes said at least one structural component such that said layer extends at only a portion of the outer surface of said fuselage.

3. A craft as claimed in claim 1 and which is an aircraft, wherein said main body is a fuselage, and said at least one structural component is the wings of the aircraft such that said layer extends only a portion of the outer surface of each of the wings of the aircraft.

4. A craft as claimed in claim 1 and which is a submarine having stabilizing fins, wherein said fins constitute said at least one structural component such that said layer extends at only a portion of the outer surface of each of the fins of the submarine.

5. A craft as claimed in claim 1 and which is a submarine having a bridge protruding from the main body of the submarine, wherein said bridge constitutes said at least one structural component such that said layer extends at only a portion of the outer surface of the bridge of the submarine.

6. A craft as claimed in claim 1 and which is an armored ground vehicle having outer panels, wherein at least one of said outer panels constitutes said at least one structural component such that said layer extends at only a portion of the outer surface of said at least one outer panel of the vehicle.

7. A craft as claimed in claim 1, wherein said thin layer of electrically conductive material comprises a plurality of spaced apart strips of electrically conductive material on the outer surface of each said at least one structural component.

8. A craft as claimed in claim 1, wherein said thin layer of electrically conductive material is a metal foil adhered to the outer surface of said at least one structural component.

9. A craft as claimed in claim 1, wherein said thin layer of electrically conductive material is a treated portion of the outer surface of said at least one structural component.

10. A craft as claimed in claim 1, wherein said thin layer is electrically conductive paint coating the outer surface of said at least one structural component.

11. A craft as claimed in claim 1, wherein said at least one structural component comprises a polymer, and said layer of electrically conductive material is a portion of the outer layer of the component doped with electrically conductive material.

12. A craft as claimed in claim 1, wherein said layer of electrically conductive material is a fiber reinforced composite material comprising electrically conductive fibers aligned parallel to one another.

13. A building or civil engineering structure, which is difficult to detect by radar, having a main structural component having an outer exposed wall terminating at front and rear corners which define front and rear edges of the wall, respectively, and a radar echo reduction constituent comprising a thin layer of electrically conductive material extending at only a portion of the outer surface of the exposed wall, said layer terminating at a rearmost edge thereof that is spaced from said rear edge of the wall such that a discontinuity in electrical conductivity occurs at the boundary between that portion of the wall over which said layer extends and that portion of the wall which is not covered by said layer, and said thin layer of electrically conductive material including at least one triangular portion extending from a front edge of the wall with the rearmost edge of the layer constituted by two legs of a triangle.

14. An object which is difficult to detect by radar, said object including a main structural component having an exposed, outer surface, and a radar echo reduction constituent comprising a layer of electrically conductive material extending at the outer surface of the component, said layer including a plurality of spaced apart strips of electrically conductive material on the component, said strips having terminal edges creating discontinuities in electrical conductivity between those portions of the component over which said strips extend and that portion of the component which is not covered with said strips, the strips of one group of said plurality of strips having respective rear terminal edges aligned within one another in a first direction, and the strips of another group of said plurality of strips having respective rear terminal edges aligned with one another in a second direction that is non-parallel to said first direction.

15. An object which is difficult to detect by radar, said object including a main structural component having an exposed, outer surface, and a radar echo reduction constituent comprising a layer of electrically conductive material extending at the outer surface of the component, said layer including a plurality of spaced apart strips of electrically conductive material on the component, said strips having terminal edges creating discontinuities in electrical conductivity between those portions of the component over which said strips extend and that portion of the component which is not covered with said strips, each of the strips including a front section and rear sections spaced from the front section on said outer surface, the rear sections each having respective rearmost terminal edges most remote from the front section, the rearmost terminal edges of the rear sections of each of the strips extending in directions that are nonparallel to one another, and said radar reduction constituent further comprising a respective switch associated with each of said strips, said switch being switchable between a first position at which the front section of a said strip is electrically conductively connected to one of the rear sections of the strip and a second position at which the front section of the strip is electrically conductively connected to another of the rear sections of the strip.

* * * * *